US011754006B1

(12) United States Patent
Son et al.

(10) Patent No.: US 11,754,006 B1
(45) Date of Patent: Sep. 12, 2023

(54) METHOD AND DEVICE FOR INCREASING PURGE RATE OF FUEL EVAPORATION GAS OF VEHICLE

(71) Applicants: Hyundai Motor Company, Seoul (KR); Kia Corporation, Seoul (KR)

(72) Inventors: Jung Seop Son, Seoul (KR); HyungSeok Yoon, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/988,433

(22) Filed: Nov. 16, 2022

(30) Foreign Application Priority Data

Jun. 15, 2022 (KR) ..... 10-2022-0072691

(51) Int. Cl.
*F02D 41/00* (2006.01)
*F02M 25/08* (2006.01)
*F02D 41/14* (2006.01)

(52) U.S. Cl.
CPC ..... *F02D 41/0045* (2013.01); *F02D 41/004* (2013.01); *F02D 41/1401* (2013.01); *F02D 41/1454* (2013.01); *F02M 25/0827* (2013.01); *F02D 2041/1432* (2013.01)

(58) Field of Classification Search
CPC ..... F02D 41/004; F02D 41/0045; F02D 41/1454; F02D 2041/1432; F02M 25/0827
See application file for complete search history.

(56) References Cited

U.S. PATENT DOCUMENTS

| | | | | |
|---|---|---|---|---|
| 7,234,450 | B1 * | 6/2007 | Takakura | F02M 25/089 73/114.38 |
| 2019/0101082 | A1 * | 4/2019 | Sanuma | F02M 25/089 |
| 2019/0186393 | A1 | 6/2019 | Oh et al. | |
| 2020/0191085 | A1 * | 6/2020 | Oh | F02D 41/0062 |
| 2021/0071598 | A1 * | 3/2021 | Nakagawa | F02D 41/003 |
| 2021/0270215 | A1 * | 9/2021 | Nakagawa | B01D 53/0454 |

* cited by examiner

*Primary Examiner* — Erick R Solis
(74) *Attorney, Agent, or Firm* — Banner & Witcoff, Ltd.

(57) ABSTRACT

A method for increasing a purge rate of fuel evaporation gas of a vehicle may include: determining, by a controller, a first fuel evaporation gas density in a purge pump included in an active fuel evaporation gas purge system of the vehicle; filtering the first fuel evaporation gas density using a filter for controlling an amount of change in the first fuel evaporation gas density; determining a second fuel evaporation gas density in the purge pump based on the filtered first fuel evaporation gas density; determining a third fuel evaporation gas density in a standard temperature and pressure state; determining a concentration of hydrocarbon within the fuel evaporation gas based on the third fuel evaporation gas density; and increasing the purge rate of the fuel evaporation gas based on the hydrocarbon concentration in the fuel evaporation gas.

14 Claims, 2 Drawing Sheets

METHOD AND DEVICE FOR INCREASING PURGE RATE OF FUEL EVAPORATION GAS OF VEHICLE

CROSS-REFERENCE TO RELATED APPLICATION

This application claims priority to and the benefit of Korean Patent Application No. 10-2022-0072691, filed in the Korean Intellectual Property Office on Jun. 15, 2022, the entire contents of which are incorporated herein by reference.

BACKGROUND

(a) Field

The present disclosure relates to a vehicle, and more particularly, to a method and a device for increasing a purge rate of fuel evaporation gas of a vehicle.

(b) Description of the Related Art

Fuel stored in a fuel tank of a vehicle evaporates according to a flow in the fuel tank and an internal temperature of the fuel tank and becomes fuel evaporation gas. When the fuel evaporation gas is leaked into the atmosphere, it can cause environmental pollution. To prevent the environmental pollution, a purge system collects the fuel evaporation gas in a canister and then introduces the fuel evaporation gas into an intake system of an engine to combust the fuel evaporation gas.

The purge system supplies the fuel evaporation gas to the intake system using a pressure acting on the fuel evaporation gas according to a negative pressure formed in the intake system. However, it is difficult for a turbocharger-mounted engine or a hybrid vehicle to generate negative pressure at a front end of an engine intake valve. Thus, it may be difficult to apply the purge system using negative intake pressure to the turbocharger-mounted engine or the hybrid vehicle.

SUMMARY

The present disclosure provides a method and a device for increasing a purge rate of fuel evaporation gas of a vehicle which are capable of increasing (improving) the purge rate of the fuel evaporation gas of the vehicle by accurately calculating a concentration of hydrocarbon (HC) that is a fuel component in the fuel evaporation gas of the vehicle.

According to the present disclosure, a method may include: determining, by a controller, a first fuel evaporation gas density in a purge pump included in an active fuel evaporation gas purge system of a vehicle based on at least one of a difference between a pressure measured at a front end of the purge pump and a pressure measured at a rear end of the purge pump, a radius of a fluid passage of the purge pump, a number of rotations of the purge pump, or an opening amount of a purge control solenoid valve that supplies fuel evaporation gas pumped by the purge pump to an intake manifold of an engine of the vehicle; filtering, by the controller, the first fuel evaporation gas density using a filter for controlling an amount of change in the first fuel evaporation gas density based on the amount of change in the first fuel evaporation gas density being greater than or equal to a reference change amount; determining, by the controller, a second fuel evaporation gas density in the purge pump based on the filtered first fuel evaporation gas density; determining, by the controller, a third fuel evaporation gas density in a standard temperature and pressure state based on the second fuel evaporation gas density, a current pressure in the purge pump, and a current temperature in the purge pump; determining, by the controller, a concentration of hydrocarbon in the fuel evaporation gas in the purge pump based on the third fuel evaporation gas density; and increasing, by the controller, a purge rate of the fuel evaporation gas based on the determined hydrocarbon concentration in the fuel evaporation gas.

Filtering may include using a low pass filter having a greater time constant than a reference time constant to filter the first fuel evaporation gas density.

The vehicle may be a hybrid vehicle operated in a lock-up charge driving mode. Increasing the purge rate may include determining, by the controller, whether an amount of the fuel evaporation gas accumulated in the intake manifold of the engine is less than or equal to a reference gas amount based on the determined hydrocarbon concentration in the fuel evaporation gas; and based on determining that the accumulated amount of fuel evaporation gas is less than or equal to the reference gas amount, controlling, by the controller, the purge control solenoid valve and the purge pump to increase the purge rate of the fuel evaporation gas.

Increasing the purge rate may include determining, by the controller, whether an amount of fuel required for driving the vehicle is less than or equal to a reference fuel amount based on the determined hydrocarbon concentration in the fuel evaporation gas; and based on the amount of fuel required for driving the vehicle being less than or equal to the reference fuel amount, controlling, by the controller, the purge control solenoid valve and the purge pump to increase the purge rate of the fuel evaporation gas so that the amount of fuel required for driving the vehicle is provided to the engine.

Increasing the purge rate may include controlling, by the controller, the purge control solenoid valve and the purge pump based on the determined hydrocarbon concentration in the fuel evaporation gas so that a target amount of fuel evaporation gas determined according to an air-fuel ratio control of the engine is supplied to the intake manifold of the engine to increase the purge rate.

Increasing the purge rate may include, based on an oxygen sensor, which is installed in an exhaust pipe of the engine and detects an oxygen concentration of an exhaust gas of the engine, generating a signal indicating abnormality and a purge operation of the fuel evaporation gas being stopped for a shorter time than a reference time, determining, by the controller, whether an amount of the fuel evaporation gas accumulated in the intake manifold of the engine is less than or equal to a reference fuel evaporation gas amount based on the determined hydrocarbon concentration in the fuel evaporation gas; and based on determining that the amount of the accumulated fuel evaporation gas is less than or equal to the reference fuel evaporation gas amount, controlling, by the controller, the purge control solenoid valve and the purge pump to increase the purge rate.

Increasing the purge rate may include, based on the fuel evaporation gas having a greater concentration than a reference concentration and a purge operation of the fuel evaporation gas being stopped for a shorter time than a reference operation time, determining, by the controller, whether an amount of the fuel evaporation gas accumulated in the intake manifold of the engine is less than or equal to a reference fuel evaporation gas amount based on the determined hydrocarbon concentration in the fuel evaporation gas; and based on determining that the accumulated amount of fuel evaporation gas is less than or equal to the reference fuel evaporation gas amount, controlling, by the controller, the purge control solenoid valve and the purge pump to increase the purge rate.

According to the present disclosure, a fuel evaporation gas purge system for a vehicle may include: a purge pump; a pressure sensor configured to detect a pressure at a front end of the purge pump and a pressure at a rear end of the purge pump; a rotation sensor configured to detect a number of rotations of the purge pump; an opening amount sensor configured to detect an opening amount of a purge control solenoid valve that supplies fuel evaporation gas pumped by the purge pump to an intake manifold of an engine of the vehicle; and a controller. The controller may be configured to: determine a first fuel evaporation gas density in the purge pump based on at least one of: a difference between the pressure at the front end of the purge pump and the pressure at the rear end of the purge pump, a radius of a fluid passage of the purge pump, the number of rotations of the purge pump, or the opening amount of the purge control solenoid valve; filter the first fuel evaporation gas density using a filter for controlling an amount of change in the first fuel evaporation gas density based on the amount of change in the first fuel evaporation gas density being greater than or equal to a reference change amount; determine a second fuel evaporation gas density in the purge pump based on the filtered first fuel evaporation gas density; determine a third fuel evaporation gas density in a standard temperature and pressure state based on the second fuel evaporation gas density, a current pressure in the purge pump, and a current temperature in the purge pump; determine a concentration of hydrocarbon in the fuel evaporation gas in the purge pump based on the third fuel evaporation gas density; and increase the purge rate of the fuel evaporation gas based on the determined hydrocarbon concentration in the fuel evaporation gas.

The controller may be configured to filter the first fuel evaporation gas density using a low pass filter having a greater time constant than a reference time constant to filter the first fuel evaporation gas density.

The vehicle may be a hybrid vehicle operated in a lock-up charge driving mode. The controller may be configured to increase the purge rate by: determining whether an amount of the fuel evaporation gas accumulated in the intake manifold of the engine is less than or equal to a reference gas amount based on the determined hydrocarbon concentration in the fuel evaporation gas; and based on determining that the accumulated amount of fuel evaporation gas is less than or equal to the reference gas amount, controlling the purge control solenoid valve and the purge pump to increase the purge rate of the fuel evaporation gas.

The controller may be configured to increase the purge rate by: determining whether an amount of fuel required for driving the vehicle is less than or equal to a reference fuel amount based on the determined hydrocarbon concentration in the fuel evaporation gas; and based on the amount of the fuel required for driving the vehicle being less than or equal to the reference fuel amount, controlling the purge control solenoid valve and the purge pump to increase the purge rate of the fuel evaporation gas so that the amount of fuel required for driving the vehicle is provided to the engine.

The controller may be configured to increase the purge rate by: controlling the purge control solenoid valve and the purge pump based on the determined hydrocarbon concentration in the fuel evaporation gas so that a target amount of fuel evaporation gas determined according to an air-fuel ratio control of the engine is supplied to the intake manifold of the engine to increase the purge rate.

The fuel evaporation gas purge system may further include an oxygen sensor installed in an exhaust pipe of the engine. The oxygen sensor may be configured to detect an oxygen concentration of an exhaust gas of the engine. The controller may be further configured to: based on the oxygen sensor generating a signal indicating abnormality and a purge operation of the fuel evaporation gas being stopped for a shorter time than a reference time, determine whether an amount of the fuel evaporation gas accumulated in the intake manifold of the engine is less than or equal to a reference fuel evaporation gas amount based on the determined hydrocarbon concentration in the fuel evaporation gas; and based on determining that the amount of the accumulated fuel evaporation gas is less than or equal to the reference fuel evaporation gas amount, control the purge control solenoid valve and the purge pump to increase the purge rate.

The controller may be configured to increase the purge rate by: based on the fuel evaporation gas having a greater concentration than a reference concentration and a purge operation of the fuel evaporation gas being stopped for a shorter time than a reference operation time, determining whether an amount of the fuel evaporation gas accumulated in the intake manifold of the engine is less than or equal to a reference fuel evaporation gas amount based on the determined hydrocarbon concentration in the fuel evaporation gas; and based on determining that the accumulated amount of fuel evaporation gas is less than or equal to the reference fuel evaporation gas amount, controlling the purge control solenoid valve and the purge pump to increase the purge rate.

An embodiment of the present disclosure may provide the device for increasing a purge rate The method and the device for increasing the purge rate of the fuel evaporation gas of the vehicle according to the embodiment of the present disclosure may increase the purge rate of the fuel evaporation gas of the vehicle by accurately calculating the concentration of hydrocarbon (HC) that is in the fuel evaporation gas of the vehicle.

BRIEF DESCRIPTION OF THE DRAWINGS

A brief description of the drawings will be provided to more sufficiently understand the drawings which are used in the detailed description of the present disclosure.

DETAILED DESCRIPTION

Figure 1:
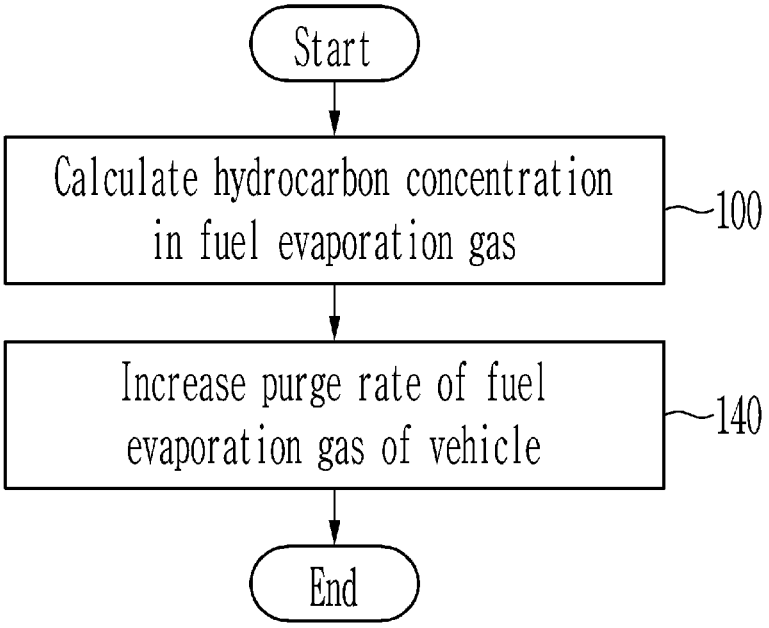
FIG. 1 is a flowchart illustrating an example method for increasing a purge rate of fuel evaporation gas of a vehicle.

In order to sufficiently understand the present disclosure and the object achieved by embodying the present disclosure, the accompanying drawings illustrating embodiments of the present disclosure and contents described in the accompanying drawings are to be referenced.

Hereinafter, the present disclosure will be described in detail by describing embodiments of the present disclosure with reference to the accompanying drawings. In describing the present disclosure, well-known configurations or functions will not be described in detail since they may unnecessarily obscure the gist of the present disclosure. Throughout the accompanying drawings, the same reference numerals will be used to denote the same components.

Terms used in the present specification are only used in order to describe specific embodiments rather than limiting the present disclosure. Singular forms are to include plural forms unless the context clearly indicates otherwise. It will be further understood that the terms "comprise," "include," or "have" used in the present specification specify the presence of features, numerals, steps, operations, components, or parts mentioned in the present specification, or a combination thereof, but do not preclude the presence or addition of one or more other features, numerals, steps, operations, components, parts, or a combination thereof.

Throughout this specification and the claims that follow, when it is described that an element is "coupled" to another element, the element may be "directly coupled" to the other element or "electrically or mechanically coupled" to the other element through a third element.

Unless defined otherwise, it is to be understood that the terms used in the present specification including technical and scientific terms have the same meanings as those that are generally understood by those skilled in the art. It must be understood that the terms defined by the dictionary are identical with the meanings within the context of the related art, and they should not be ideally or excessively formally defined unless the context clearly dictates otherwise.

An active purge system may operate a purge pump to forcibly purge the fuel evaporation gas. An active purge system in related art, however, may not accurately calculate a concentration of hydrocarbon (HC) in fuel evaporation gas when the concentration of fuel evaporation gas introduced into a purge pump sharply increases or decreases.

Figure 2:
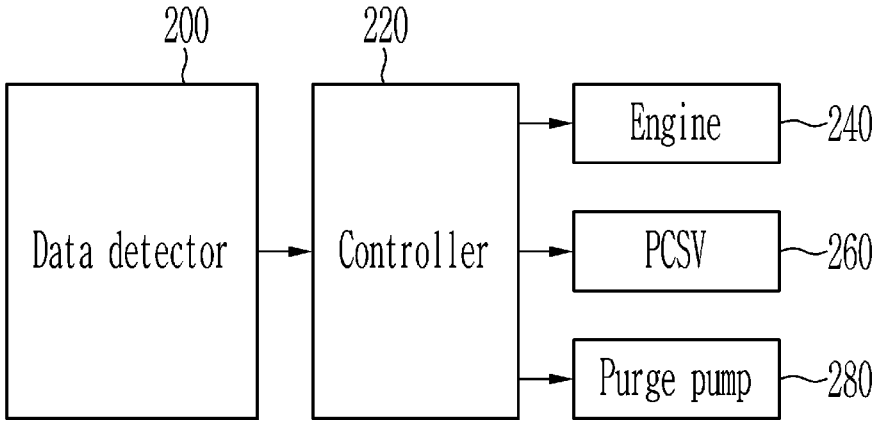
FIG. 2 is a block diagram illustrating an example device for increasing purge rate of fuel evaporation gas of a vehicle to which the method for increasing purge rate of the fuel evaporation gas of the vehicle shown in FIG. 1 is applied.

FIG. 1 is a flowchart illustrating an example method for increasing purge rate of fuel evaporation gas of a vehicle. FIG. 2 is a block diagram illustrating an example device for increasing purge rate of fuel evaporation gas of a vehicle to which the method for increasing purge rate of the fuel evaporation gas of the vehicle shown in FIG. 1 is applied.

Referring to FIG. 1 and FIG. 2, in a step 100, a controller 220 may calculate a first fuel evaporation gas density in a purge pump 280 (or a first density of fuel evaporation gas introduced through the purge pump). The calculation may be based on a difference between a pressure signal at a front end of the purge pump and a pressure signal at a rear end of the purge pump included in an active fuel evaporation gas purge system (or an active fuel vapor purge system) of the vehicle (e.g., a hybrid electric vehicle), a radius of a fluid passage of the purge pump (or a radius of an impeller of the purge pump), a number of rotations signal of the purge pump, and/or an opening amount signal of a purge control solenoid valve (PCSV) 260 that supplies fuel evaporation gas pumped (e.g., supplied) by the purge pump 280 to an intake manifold of an engine 240. The fuel evaporation gas may refer to a gas (e.g., a fuel vapor) evaporated from a fuel tank of the vehicle. For example, the controller 220 may calculate the first fuel evaporation gas density in the purge pump 280 using the following equation.

$$\text{First fuel evaporation gas density}=(2\times\Delta P)/\{K\times(2\pi\cdot r\cdot f)^2\}$$

In the equation, ΔP may be a pressure difference between both ends of the purge pump 280, K may be a flow coefficient and may be determined according to an opening amount of the purge control solenoid valve (PCSV) 260 and a number of rotations of the purge pump 280, r may be the radius of the fluid passage of the purge pump 280, and f may be a number of rotations of the purge pump 280 and a unit of f may be Hz.

As shown in FIG. 2, the vehicle may include a data detector 200, the controller 220, the engine 240, the purge control solenoid valve (PCSV) 260, and the purge pump 280 including a motor and the impeller rotating by power of the motor.

The active fuel evaporation gas purge system may include the purge control solenoid valve (PCSV) 260 and the purge pump 280, and may forcibly purge the fuel evaporation gas of the vehicle by operating the purge pump 280.

The purge pump 280 may pump the fuel evaporation gas collected in a canister to the purge control solenoid valve (PCSV) 260. For example, the purge pump 280 may be operated when an amount of hydrocarbon in the fuel evaporation gas is greater than a set amount (e.g., a threshold amount). The canister may store the collected fuel evaporation gas that evaporates from the fuel tank of the vehicle. The purge control solenoid valve (PCSV) 260 may selectively block the fuel evaporation gas collected in the canister and may supply the pumped fuel evaporation gas to the intake manifold of the engine 240.

The device for adjusting (e.g., increasing or decreasing) a purge rate of the fuel evaporation gas of the vehicle may include the data detector 200 and the controller 220.

The data detector 200 may include a pressure sensor, a rotation sensor, and/or an opening amount sensor. The pressure sensor may detect the pressure signal at the front end of the purge pump 280 and the pressure signal at the rear end of the purge pump and may provide (e.g., transmit) the detected signals to the controller 220. The rotation sensor (e.g., a revolution sensor) may detect (e.g., receive or generate) a signal indicating a number (e.g., quantity) of rotations (e.g., revolutions) of the purge pump 280 and provide the detected signal to the controller 220. The opening amount sensor may detect (e.g., receive or generate) the opening amount signal of the PCSV 260 and provide the detected signal to the controller 220.

The controller 220 may be an electronic control unit (ECU) and may control an entire or partial operation of the vehicle. For example, the controller 220 may be one or more microprocessors operated by a program (e.g., a control logic) or hardware (e.g., a microcomputer) including the microprocessor. The program may include a series of commands for executing the method for increasing the purge rate of the fuel evaporation gas of the vehicle. The commands may be stored in a memory of the controller 220.

The controller 220 may determine, using the calculated first fuel evaporation gas density, whether a fuel evaporation gas density in the purge pump 280 has increased or decreased. If the first fuel evaporation gas density increases or decreases rapidly (e.g., if a rate of change in the first fuel evaporation gas density is greater than or equal to a reference rate of change), the controller 220 may filter the first fuel evaporation gas density (e.g., the first fuel evaporation gas density value or the first fuel evaporation gas density signal) using a low pass filter (LPF) for controlling (e.g., adjusting) the amount (e.g., rate) of change in the first fuel evaporation gas density. For example, the amount (e.g., rate) of change may be a sharp change amount greater than the reference change amount (e.g., rate). The reference change amount may be determined empirically (e.g., by experiment).

When the amount (e.g., rate) of change in the first fuel evaporation gas density is greater than or equal to the reference change amount (e.g., when the first fuel evaporation gas density changes rapidly), the controller 220 may use the low pass filter (LPF) having a greater time constant than a reference time constant to filter the first fuel evaporation gas density.

The controller 220 may calculate a second fuel evaporation gas density in the purge pump 280 based on the filtered first fuel evaporation gas density. Therefore, a more accurate fuel evaporation gas density in the purge pump 280 may be calculated. For example, the controller 220 may calculate the second fuel evaporation gas density using the equation for calculating the first fuel evaporation gas density.

The controller 220 may calculate a third fuel evaporation gas density in a standard temperature and pressure state based on the second fuel evaporation gas density, a current pressure in the purge pump 280, and a current temperature in the purge pump 280. For example, the controller 220 may calculate the third fuel evaporation gas density in a standard temperature and pressure state using the following equation.

Third fuel evaporation gas density in the standard temperature and pressure state=the second fuel evaporation gas density×(1/(the current pressure))×{(273.15+(the current temperature))/273.15}

In the equation, the current pressure and the current temperature may be the current pressure and the current temperature in the purge pump 280, and may be detected by a sensor included in the data detector 200 to be provided to the controller 220.

The controller 220 may calculate a concentration of hydrocarbon within a fuel evaporation gas in the purge pump 280 using the third fuel evaporation gas density in the standard temperature and pressure state. For example, the controller 220 may calculate the concentration of hydrocarbon in the fuel evaporation gas using the equation below. For example, the hydrocarbon may be butane.

Concentration of hydrocarbon in the fuel evaporation gas={(the third fuel evaporation gas density in the standard temperature and pressure state−an air density in the standard temperature and pressure state)/(a density of hydrocarbon in the standard temperature and pressure state−the air density in the standard temperature and pressure state)}×100

For example, the controller 220 may calculate a concentration of the butane in the fuel evaporation gas by designating the hydrocarbon in the equation as butane. A unit of the concentration of the hydrocarbon may be percentage (%).

The controller 220 may control the engine 240, the PCSV 260, and the purge pump 280 based on the calculated hydrocarbon concentration in the fuel evaporation gas.

According to step 140 shown in FIG. 1, the controller 220 may increase the purge rate (or a purge amount) of the fuel evaporation gas of the vehicle based on the calculated hydrocarbon concentration in the fuel evaporation gas.

According to one or more embodiments for increasing the purge rate of the fuel evaporation gas of the vehicle, when the vehicle is a hybrid vehicle (e.g., a hybrid electric vehicle) and the hybrid vehicle is operated in a lock-up charge driving mode, the controller 220 may determine whether an amount of fuel evaporation gas accumulated in the intake manifold of the engine 240 is less than or equal to a reference gas amount based on the calculated hydrocarbon concentration in the fuel evaporation gas. The lock-up charge driving mode may mean an operation mode in which a battery is charged by power of the engine 240 using an electric motor that is a drive motor of the hybrid vehicle when a driving force of the engine is unnecessary (e.g., when the hybrid vehicle is coasting due to an off state of an accelerator pedal) in a state in which an engine clutch of the hybrid vehicle is locked-up (or engaged). The lock-up charge driving mode may be an operation mode that requires power of the engine.

When the accumulated amount of fuel evaporation gas is less than or equal to the reference gas amount, the controller 220 may control the PCSV 260 and the purge pump 280 to increase the purge rate of the fuel evaporation gas of the hybrid vehicle.

According to one or more embodiments for increasing the purge rate of the fuel evaporation gas of the vehicle, the controller 220 may determine whether an amount of fuel required for driving the vehicle is less than or equal to a reference fuel amount based on the calculated hydrocarbon concentration in the fuel evaporation gas.

When the amount of fuel required for driving the vehicle is less than or equal to the reference fuel amount, the controller 220 may control the PCSV 260 and the purge pump 280 to increase the purge rate of the fuel evaporation gas of the vehicle so that the amount of fuel required for driving the vehicle is provided to the engine 240.

According to one or more embodiments for increasing the purge rate of the fuel evaporation gas of the vehicle, the controller 220 may control the purge pump 280 and the PCSV 260 based on the calculated hydrocarbon concentration in the fuel evaporation gas so that a target amount of fuel evaporation gas determined according to an air-fuel ratio control of the engine 240 is supplied to the intake manifold of the engine to increase the purge rate of the fuel evaporation gas of the vehicle.

According to one or more embodiments for increasing the purge rate of the fuel evaporation gas of the vehicle, when an oxygen sensor, which is installed in an exhaust pipe of the engine 240 or installed in front of the exhaust pipe connected to a catalyst device and detects an oxygen concentration of an exhaust gas of the engine, generates an abnormal signal so that a purge operation of the fuel evaporation gas of the vehicle is stopped for a shorter time than a reference time, the controller 220 may determine whether an amount of fuel evaporation gas accumulated in the intake manifold of the engine is less than or equal to a reference fuel evaporation gas amount based on the calculated hydrocarbon concentration in the fuel evaporation gas. If the amount of the accumulated fuel evaporation gas is less than or equal to the reference fuel evaporation gas amount, the controller 220 may control the PCSV 260 and the purge pump 280 to increase the purge rate of the fuel evaporation gas of the vehicle.

According to one or more embodiments for increasing the purge rate of the fuel evaporation gas of the vehicle, when the fuel evaporation gas of a high concentration (e.g., a greater concentration than a reference concentration) is generated so that a purge operation of the fuel evaporation gas of the vehicle is stopped for a shorter time than a reference operation time, the controller 220 may determine whether an amount of fuel evaporation gas accumulated in the intake manifold of the engine 240 is less than or equal to a reference fuel evaporation gas amount based on the calculated hydrocarbon concentration in the fuel evaporation gas. When the accumulated amount of fuel evaporation gas is less than or equal to the reference fuel evaporation gas amount, the controller 220 may control the PCSV 260 and the purge pump 280 to increase the purge rate of the fuel evaporation gas of the vehicle.

The components, "units," "-or," blocks, or modules used in an embodiment of the present disclosure may be implemented by software such as tasks, classes, sub-routines, processes, objects, execution threads, or programs performed in a predetermined region on a memory or hardware such as a processor, a field-programmable gate array (FPGA), or an application-specific integrated circuit (ASIC), and may be implemented by a combination of the software and the hardware. The components, "part," or the like may be embedded in a computer-readable storage medium, and some part thereof may be dispersedly distributed in a plurality of computers.

As set forth above, embodiments have been disclosed in the accompanying drawings and the specification. Herein, specific terms have been used, but are just used for the purpose of describing the present disclosure and are not used for qualifying the meaning or limiting the scope of the present disclosure, which is disclosed in the appended claims. Therefore, it will be understood by those skilled in the art that various modifications and equivalent embodiments are possible from the present disclosure. Accordingly, the actual technical protection scope of the present disclosure must be determined by the spirit of the appended claims.

What is claimed is:

1. A method comprising:

determining, by a controller, a first fuel evaporation gas density in a purge pump included in an active fuel evaporation gas purge system of a vehicle based on at least one of:

a difference between a pressure measured at a front end of the purge pump and a pressure measured at a rear end of the purge pump, a radius of a fluid passage of the purge pump, a number of rotations of the purge pump, or an opening amount of a purge control solenoid valve that supplies fuel evaporation gas pumped by the purge pump to an intake manifold of an engine of the vehicle;

filtering, by the controller, the first fuel evaporation gas density using a filter for controlling an amount of change in the first fuel evaporation gas density based on the amount of change in the first fuel evaporation gas density being greater than or equal to a reference change amount;

determining, by the controller, a second fuel evaporation gas density in the purge pump based on the filtered first fuel evaporation gas density;

determining, by the controller, a third fuel evaporation gas density in a standard temperature and pressure state based on the second fuel evaporation gas density, a current pressure in the purge pump, and a current temperature in the purge pump;

determining, by the controller, a concentration of hydrocarbon in the fuel evaporation gas in the purge pump based on the third fuel evaporation gas density; and increasing, by the controller, a purge rate of the fuel evaporation gas based on the determined concentration of hydrocarbon in the fuel evaporation gas.

2. The method of claim 1, wherein the filtering comprises using a low pass filter having a greater time constant than a reference time constant to filter the first fuel evaporation gas density.

3. The method of claim 1, wherein the vehicle is a hybrid vehicle operated in a lock-up charge driving mode, and wherein the increasing the purge rate comprises:

determining, by the controller, whether an amount of the fuel evaporation gas accumulated in the intake manifold of the engine is less than or equal to a reference gas amount based on the determined concentration of hydrocarbon in the fuel evaporation gas; and based on determining that the accumulated amount of fuel evaporation gas is less than or equal to the reference gas amount, controlling, by the controller, the purge control solenoid valve and the purge pump to increase the purge rate of the fuel evaporation gas.

4. The method of claim 1, wherein the increasing the purge rate comprises:

determining, by the controller, whether an amount of fuel required for driving the vehicle is less than or equal to a reference fuel amount based on the determined concentration of hydrocarbon in the fuel evaporation gas; and based on the amount of fuel required for driving the vehicle being less than or equal to the reference fuel amount, controlling, by the controller, the purge control solenoid valve and the purge pump to increase the purge rate of the fuel evaporation gas so that the amount of fuel required for driving the vehicle is provided to the engine.

5. The method of claim 1, wherein the increasing the purge rate comprises:

controlling, by the controller, the purge control solenoid valve and the purge pump based on the determined concentration of hydrocarbon in the fuel evaporation gas so that a target amount of fuel evaporation gas determined according to an air-fuel ratio control of the engine is supplied to the intake manifold of the engine to increase the purge rate.

6. The method of claim 1, wherein the increasing the purge rate comprises:

based on an oxygen sensor, which is installed in an exhaust pipe of the engine and detects an oxygen concentration of an exhaust gas of the engine, generating a signal indicating abnormality and a purge operation of the fuel evaporation gas being stopped for a shorter time than a reference time, determining, by the controller, whether an amount of the fuel evaporation gas accumulated in the intake manifold of the engine is less than or equal to a reference fuel evaporation gas amount based on the determined concentration of hydrocarbon in the fuel evaporation gas; and based on determining that the amount of the accumulated fuel evaporation gas is less than or equal to the reference fuel evaporation gas amount, controlling, by the controller, the purge control solenoid valve and the purge pump to increase the purge rate.

7. The method of claim 1, wherein the increasing the purge rate comprises:

based on the fuel evaporation gas having a greater concentration than a reference concentration and a purge operation of the fuel evaporation gas being stopped for a shorter time than a reference operation time, determining, by the controller, whether an amount of the fuel evaporation gas accumulated in the intake manifold of the engine is less than or equal to a reference fuel evaporation gas amount based on the determined concentration of hydrocarbon in the fuel evaporation gas; and based on determining that the accumulated amount of fuel evaporation gas is less than or equal to the reference fuel evaporation gas amount, controlling, by the controller, the purge control solenoid valve and the purge pump to increase the purge rate.

8. A fuel evaporation gas purge system for a vehicle, the fuel evaporation gas purge system comprising:

a purge pump;

a pressure sensor configured to detect a pressure at a front end of the purge pump and a pressure at a rear end of the purge pump;

a rotation sensor configured to detect a number of rotations of the purge pump;

an opening amount sensor configured to detect an opening amount of a purge control solenoid valve that supplies fuel evaporation gas pumped by the purge pump to an intake manifold of an engine of the vehicle; and a controller configured to:

determine a first fuel evaporation gas density in the purge pump based on at least one of:

a difference between the pressure at the front end of the purge pump and the pressure at the rear end of the purge pump, a radius of a fluid passage of the purge pump, the number of rotations of the purge pump, or the opening amount of the purge control solenoid valve;

filter the first fuel evaporation gas density using a filter for controlling an amount of change in the first fuel evaporation gas density based on the amount of change in the first fuel evaporation gas density being greater than or equal to a reference change amount;

determine a second fuel evaporation gas density in the purge pump based on the filtered first fuel evaporation gas density;

determine a third fuel evaporation gas density in a standard temperature and pressure state based on the second fuel evaporation gas density, a current pressure in the purge pump, and a current temperature in the purge pump;

determine a concentration of hydrocarbon in the fuel evaporation gas in the purge pump based on the third fuel evaporation gas density; and increase a purge rate of the fuel evaporation gas based on the determined concentration of hydrocarbon in the fuel evaporation gas.

9. The fuel evaporation gas purge system of claim 8, wherein the controller is configured to filter the first fuel evaporation gas density using a low pass filter having a greater time constant than a reference time constant to filter the first fuel evaporation gas density.

10. The fuel evaporation gas purge system of claim 8, wherein the vehicle is a hybrid vehicle operated in a lock-up charge driving mode, and wherein the controller is configured to increase the purge rate by:

determining whether an amount of the fuel evaporation gas accumulated in the intake manifold of the engine is less than or equal to a reference gas amount based on the determined concentration of hydrocarbon in the fuel evaporation gas; and based on determining that the accumulated amount of fuel evaporation gas is less than or equal to the reference gas amount, controlling the purge control solenoid valve and the purge pump to increase the purge rate of the fuel evaporation gas.

11. The fuel evaporation gas purge system of claim 8, wherein the controller is configured to increase the purge rate by:

determining whether an amount of fuel required for driving the vehicle is less than or equal to a reference fuel amount based on the determined concentration of hydrocarbon in the fuel evaporation gas; and based on the amount of the fuel required for driving the vehicle being less than or equal to the reference fuel amount, controlling the purge control solenoid valve and the purge pump to increase the purge rate of the fuel evaporation gas so that the amount of fuel required for driving the vehicle is provided to the engine.

12. The fuel evaporation gas purge system of claim 8, wherein the controller is configured to increase the purge rate by:

controlling the purge control solenoid valve and the purge pump based on the determined concentration of hydrocarbon in the fuel evaporation gas so that a target amount of fuel evaporation gas determined according to an air-fuel ratio control of the engine is supplied to the intake manifold of the engine to increase the purge rate.

13. The fuel evaporation gas purge system of claim 8, further comprising an oxygen sensor installed in an exhaust pipe of the engine, wherein the oxygen sensor is configured to detect an oxygen concentration of an exhaust gas of the engine, and wherein the controller is further configured to:

based on the oxygen sensor generating a signal indicating abnormality and a purge operation of the fuel evaporation gas being stopped for a shorter time than a reference time, determine whether an amount of the fuel evaporation gas accumulated in the intake manifold of the engine is less than or equal to a reference fuel evaporation gas amount based on the determined concentration of hydrocarbon in the fuel evaporation gas; and based on determining that the amount of the accumulated fuel evaporation gas is less than or equal to the reference fuel evaporation gas amount, control the purge control solenoid valve and the purge pump to increase the purge rate.

14. The fuel evaporation gas purge system of claim 8, wherein the controller is configured to increase the purge rate by:

based on the fuel evaporation gas having a greater concentration than a reference concentration and a purge operation of the fuel evaporation gas being stopped for a shorter time than a reference operation time, determining whether an amount of the fuel evaporation gas accumulated in the intake manifold of the engine is less than or equal to a reference fuel evaporation gas amount based on the determined concentration of hydrocarbon in the fuel evaporation gas; and based on determining that the accumulated amount of fuel evaporation gas is less than or equal to the reference fuel evaporation gas amount, controlling the purge control solenoid valve and the purge pump to increase the purge rate.

* * * * *